US005154533A

United States Patent [19]

Baldea

[11] Patent Number: 5,154,533

[45] Date of Patent: Oct. 13, 1992

[54] METHOD FOR ROUTING TRAFFIC ON DIVIDED HIGHWAYS

[76] Inventor: Pavel Baldea, 1121 Worthington Ridge, Berlin, Conn. 06037

[21] Appl. No.: 687,181

[22] Filed: Apr. 18, 1991

[51] Int. Cl.[5] ..... E01C 1/00

[52] U.S. Cl. ..... 404/1; 404/9

[58] Field of Search ..... 404/1, 6, 8, 9; 40/612

[56] References Cited

U.S. PATENT DOCUMENTS 3,194,128 7/1965 Lechner ..... 404/1

3,766,881 10/1973 Ward ..... 404/10 X

*Primary Examiner*—William P. Neuder

*Attorney, Agent, or Firm*—Robert S. Smith

[57] ABSTRACT

A method for routing traffic along a divided highway having a plurality of crossovers between respective sides originally intended for travel in first and second directions which includes providing a first plurality of signs for traffic going in the first direction prior to at least a first crossover; providing at least a first sign at least said first crossover for traffic proceeding in the first direction; providing a second plurality of signs for traffic proceeding in the first direction after the crossover; providing the same first plurality of signs for traffic going in the second direction prior to the crossover; providing the same first sign at said first crossover for traffic proceeding in the second direction; and providing the same first plurality of signs for traffic proceeding in the second direction after the crossover.

7 Claims, 3 Drawing Sheets

METHOD FOR ROUTING TRAFFIC ON DIVIDED HIGHWAYS

BACKGROUND OF THE INVENTION

The invention relates to a method of routing traffic on divided highways and particularly to a method of routing traffic on divided highways which is particularly of value when an accident is blocking one lane, when the predominant flow of traffic is all in a single direction, when construction is blocking a lane or even as the result of weather conditions such as a flooded section of highway.

The delays caused by such disruptions result in major delays for travellers as well as the loss of many otherwise productive hours and the waste of enormous quantities of fuel while engines are left idling in bumper to bumper traffic.

The prior art includes methods of directing traffic that include the use of traffic lights on multi-lane highways that are not divided. In a typical application a four lane highway may have two lanes for traffic proceeding in a first direction and two lanes for traffic proceeding in a second direction during off peak periods of travel such as mid-day and night times. Typically, this system may be as implemented as simply as turning the traffic lights for one of the lanes nominally for traffic proceeding in the first direction all red continuously and providing warning signs for traffic proceeding in the first direction that only one lane is available during certain hours. Simultaneously, traffic proceeding in the second direction is provided with three lanes in which each lane is simultaneously displayed the same cycle of sequentially displayed green, yellow and red lights. This method is particularly adapted to cyclical patterns of traffic flow where, for example, there is a regular pattern such as a peak of traffic into a city in the morning and a peak of traffic out in the evening.

Manual procedures are also for even divided highways in which construction workers typically shunt traffic from one or often two lanes to a crossover that carries the traffic to the other side of the divider so that, for example, one lane of traffic will proceed in a first direction and one lane will proceed in a second direction and both lanes are disposed on the same side of the divider.

The later system is best adapted to construction situations where the requirement for rerouting of traffic can be anticipated well in advance and will often stay in effect for long periods of time.

It is an object of the invention to provide a method for diverting traffic in a multi-lane divided highway to deal with problems created by accidents, construction and the dominant flow of traffic being in a single direction.

It is another object of the invention to provide a method that may implemented rapidly to deal with rapidly changing situations such as accidents or even evolving unexpected weather related situations such as a stretch of flooded highway.

It is still another object of the invention to provide a method of directing traffic that may even be implemented remotely and does not require the presence of human beings at the site of the traffic disruption.

Yet another object of the invention is to minimize the waste of gasoline that results from many people being forced to wait, often for hours, because of traffic delays resulting from accidents that block traffic, construction that blocks traffic, or other disruption of traffic.

Still another object of the invention is to minimize costs by providing an array of signs that control the detour path of traffic that may be used in all directions.

SUMMARY OF THE INVENTION

It has now been found that these and other objects of the invention may be attained in a method for routing traffic along a divided highway having a plurality of crossovers between respective sides originally intended for travel in first and second directions which includes providing a first plurality of signs for traffic going in the first direction prior to at least a first crossover; providing at least a first sign at least said first crossover for traffic proceeding in the first direction; providing a second plurality of signs for traffic proceeding in the first direction after the crossover; providing the same first plurality of signs for traffic going in the second direction prior to the crossover; providing the same first sign at said first crossover for traffic proceeding in the second direction; and providing the same first plurality of signs for traffic proceeding in the second direction after the crossover.

In some forms of the invention the method provides for activation or illumination to provide a visual display of all of the signs for traffic in the first direction any one time. In other forms of the invention all of the signs for traffic in the second direction are activated at any one time.

The may be accomplished remote from the site of the individual signs. In some forms of the invention the method includes providing the same array of signs around a second crossover as are around the first crossover.

BRIEF DESCRIPTION OF THE DRAWING

The invention will be better understood by reference to the accompanying drawing in which.

DESCRIPTION OF THE PREFERRED EMBODIMENT

Figure 1:
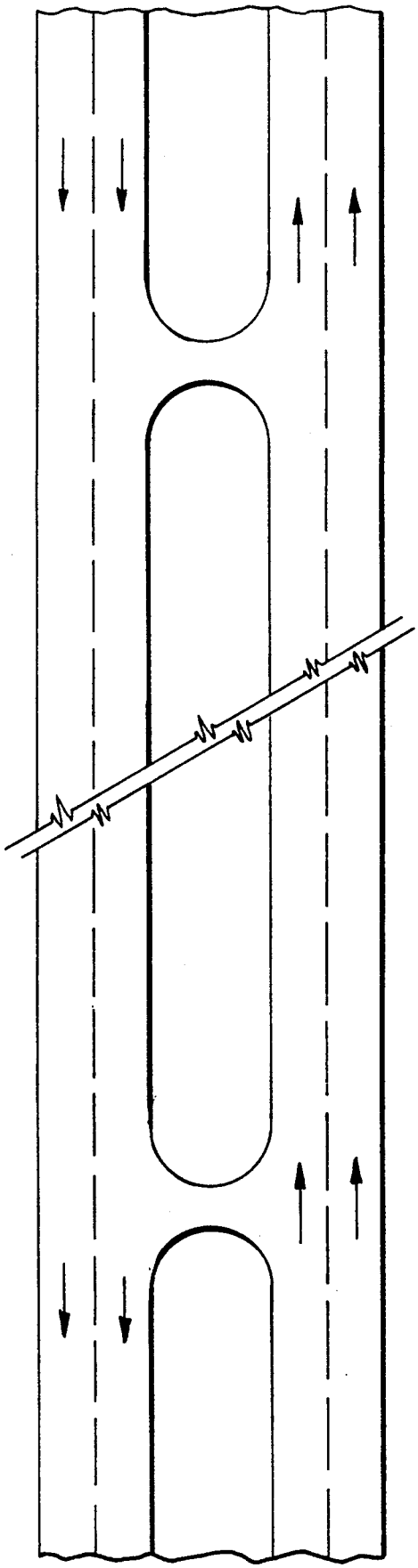
FIG. 1 is a schematic plan view of the traffic flow pattern for a four lane highway when all the lanes on one side are dedicated to traffic proceeding in a first direction and all the lanes on the other side are dedicated to traffic proceeding in a second direction as in the usual and customary practice. This is consistent with the flow pattern with no diversion.
Figure 2:
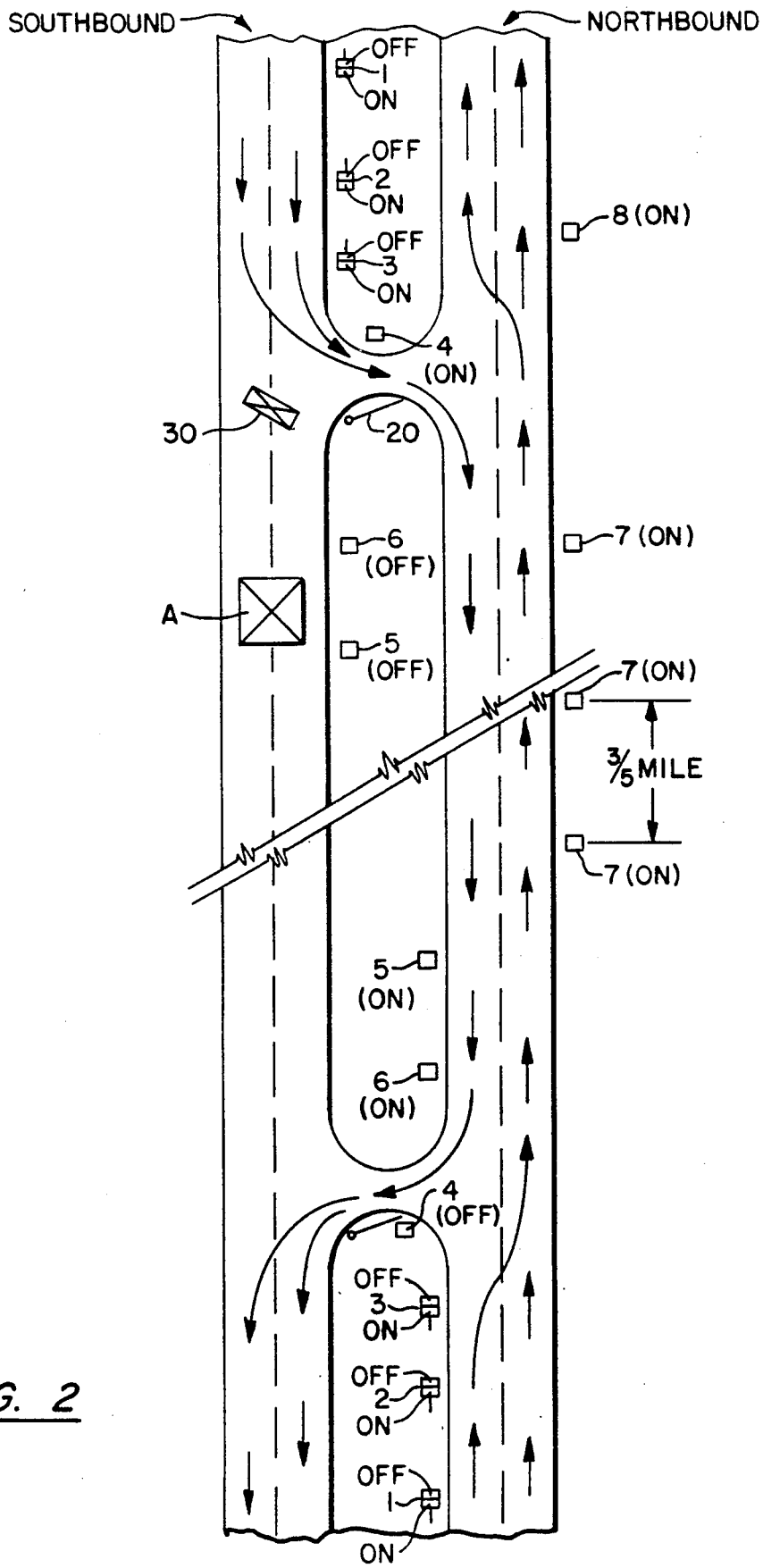
FIG. 2 is a schematic plan view of the traffic flow pattern when there is an obstruction blocking the two southbound lanes.
Figure 3:
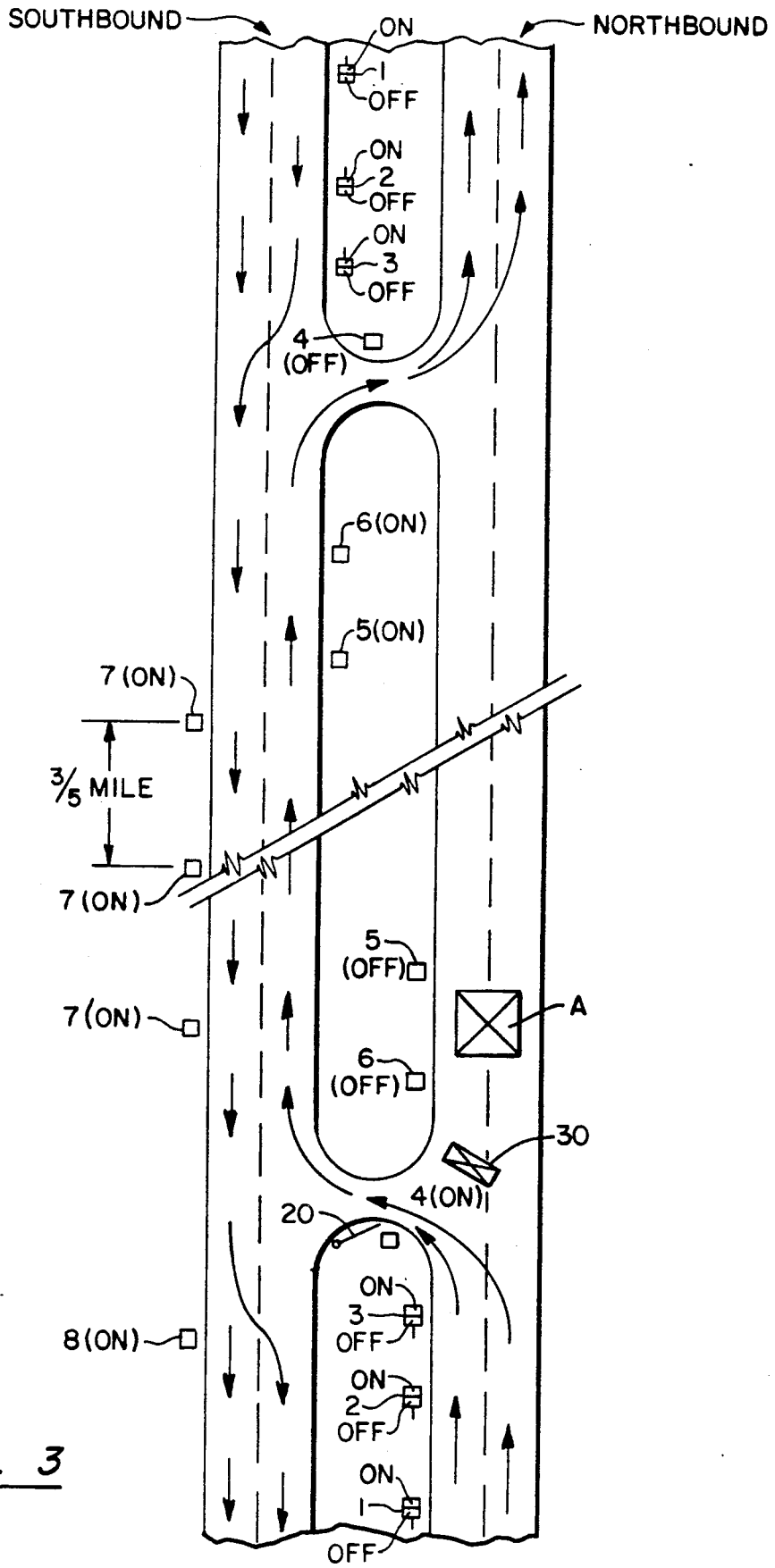
FIG. 3 is a schematic plan view of the traffic flow pattern when there is an obstruction blocking the two northbound lanes.

Referring now to FIGS. 1, 2 and 3 there are shown three schematic plan views showing three alternative traffic flow patterns in accordance with the invention. It will be understood that for simplicity the signs that are operative in the situation shown in FIG. 2 as well as those that are operative in the situation shown in FIG. 3 are all present at all or at least a large number of crossovers in the divided highway. The presence of a large number of such controls will result in much more efficient utilization of the existing highway.

In the preferred form of the invention the highway is provided with a plurality of signs near each cross over location. The signs near each crossover are selectively illuminated and thus displayed to oncoming traffic.

The signs that are sequentially visible to traffic approaching the crossover are designated by reference numerals 1, 2, 3, 4, 5, 6, 7 and 8. It will be understood that signs 1, 2 and 3 have upper and lower parts and that only one such part on any one sign will be visible at any one time. The upper part will direct traffic that is making a crossover and the lower part will direct traffic that is being moved to the right lane or lanes. It will be understood that although the description herein has for simplicity been described in terms of a four lane highway the invention has application to higways having additional lanes. The numerals designating the respective signs and the respective wording of the signs are:

1 TWO WAY TRAFFIC-CROSSOVER AHEAD (upper part of sign)
TWO WAY TRAFFIC AHEAD (lower part of sign)
2 USE LEFT LANE ONLY—300 FEET (upper part of sign)
USE RIGHT LANE ONLY—300 FEET (lower part of sign)
3 ←(FLASHING ARROW) (upper part of sign)
→(FLASHING ARROW) (lower part of sign)
4 USE RIGHT LANE ONLY
5 CROSSOVER AHEAD
6 →(FLASHING ARROW)
7 TWO WAY TRAFFIC—USE RIGHT LANE ONLY
8 END OF LANE RESTRICTIONS In some embodiments of the invention the same sign may have front and back portions that may be individually illuminated to display different messages. For example, a sign disposed at the crossover may display USE RIGHT LANE ONLY on one side and DETOUR on the other side.

Referring particularly to FIG. 2 it will be seen that an accident A in the southbound lane results in activation (such as by turning on a neon sign or illumination to make the letters visible) of northbound signs 1 (lower part), 2 (lower part) and 3 (lower part) 7, 7, 7, and 8. This will cause northbound traffic to move to the right lane or lanes. Concurrently, the southbound signs 1 (upper part), 2 (upper part), 3 (upper part), 4, 5, and 6 are illuminated to cause the southbound traffic to initially move to the left lane and then after passing the crossover to the right lane on the opposite side of the highway.

Referring now particularly to FIG. 3 there is shown the traffic pattern when there is an accident A blocking the northbound lanes. Southbound traffic has the 1 (lower part), 2 (lower part), and 3 (lower part), 7, 7, 7, and 8 visible to direct that traffic to the right lane or lanes. The signs 1 (upper part), 2 (upper part), 3 (upper part), 4, 5, and 6 are sequentially visible to the northbound traffic. Advantageously, the same signs are used to control the flow of northbound traffic as control the southbound traffic and shown in FIG. 2. This has the decided advantage that the same signs can be used to control the traffic proceeding northbound or southbound or any other direction. Thus, the cost of manufacture and the cost of maintain an inventory of the required signs is minimized.

In various forms of the invention gates may 20 be utilized at the crossovers to prevent unintended use of the crossovers. Optionally, a police car 30 or other barrier may be disposed at the crossover to further insure that a driver does not ignore the signs indicating that a crossover is required.

The operation of the signs is preferably done by remote control such as by microwaves. Alternatively, the signs may be operated manually.

The invention has been described with reference to its illustrated preferred embodiment. Persons skilled in the art of such methods may upon exposure to the teachings herein, conceive other variations. Such variations are deemed to be encompassed by the disclosure, the invention being delimited only by the following claims.

Having thus described my invention I claim:

1. A method for routing traffic along a divided highway having a plurality of crossovers between respective sides originally intended for travel in first and second directions which comprises:

providing a first plurality of signs for traffic going in the first direction prior to at least a first crossover;

providing at least a first sign at said first crossover for traffic proceeding in the first direction;

providing a second plurality of signs for traffic proceeding in the first direction after the crossover;

providing the same first plurality of signs for traffic going in the second direction prior to the crossover;

providing the same first sign at said first crossover for traffic proceeding in the second direction; and providing the same first plurality of signs for traffic proceeding in the second direction after the crossover.

2. The method as described in claim 1 wherein:

all of the signs for traffic in the first direction are activated at any one time.

3. The method as described in claim 2 wherein:

all of the signs for traffic in the second direction are activated at any one time.

4. The method as described in claim 3 wherein:

activation is accomplished remote from the site of the individual signs.

5. The method as described in claim 1 further including:

providing the same array of signs around a second crossover as are around the first crossover.

6. The method as described in claim 2 further including:

providing the same array of signs past a second crossover as are around the first crossover.

7. The method as described in claim 3 further including:

providing the same array of signs around a second crossover as are around the first crossover.

* * * * *